US010246645B2

(12) United States Patent
Froehle et al.

(10) Patent No.: US 10,246,645 B2
(45) Date of Patent: Apr. 2, 2019

(54) METHODS FOR REDUCING FLUE GAS EMISSIONS FROM FLUID CATALYTIC CRACKING UNIT REGENERATORS

(71) Applicant: UOP LLC, Des Plaines, IL (US)

(72) Inventors: Derek Froehle, Wheeling, IL (US); Stanley Joseph Frey, Palatine, IL (US); Patrick D. Walker, Park Ridge, IL (US); Andrew R. Novotny, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 71 days.

(21) Appl. No.: 15/473,162

(22) Filed: Mar. 29, 2017

(65) Prior Publication Data

US 2017/0204338 A1 Jul. 20, 2017

Related U.S. Application Data

(63) Continuation of application No. PCT/US2015/052164, filed on Sep. 25, 2015.

(60) Provisional application No. 62/056,693, filed on Sep. 29, 2014.

(51) Int. Cl.
*C10G 11/18* (2006.01)

(52) U.S. Cl.
CPC ..... *C10G 11/18* (2013.01); *C10G 11/182* (2013.01); *C10G 11/187* (2013.01); *C10G 2300/80* (2013.01)

(58) Field of Classification Search
CPC ..... C10G 11/18; C10G 11/182; C10G 11/187
See application file for complete search history.

(56) References Cited

U.S. PATENT DOCUMENTS

| | | | |
|---|---|---|---|
| 6,673,133 | B2 | 1/2004 | Sechrist et al. |
| 7,011,740 | B2 | 3/2006 | Tallman et al. |
| 8,524,960 | B2 | 9/2013 | O'Connor et al. |

(Continued)

FOREIGN PATENT DOCUMENTS

| | | |
|---|---|---|
| GB | 1566579 A | 5/1980 |
| WO | 9723581 A1 | 7/1997 |

OTHER PUBLICATIONS

Hopkins, Chris, Torrefaction to Improve Biomass for Energy and Blofuels Production and Carbon Sequestion, International Bioenergy & Bioproducts Conference, Mar. 2011 (obtained from http://www.tappi.org/content/Events/11BIOPRO/8.2Hopkins.pdf) (Year: 2011).*

(Continued)

*Primary Examiner* — Renee Robinson
(74) *Attorney, Agent, or Firm* — Paschall & Maas Law Office, LLC; James C. Paschall

(57) ABSTRACT

Methods for reducing flue gas particulate emissions from fluid catalytic cracking unit regenerators are provided. In one embodiment, a method for reducing flue gas particulate emissions from an FCC unit regenerator includes the steps of combining biochar with a hydrocarbon feedstock to generate a biochar-containing feedstock and contacting the biochar-containing feedstock with an FCC catalyst. In another embodiment, a method for reducing flue gas particulate emissions from a FCC unit regenerator includes the steps of fluidizing catalyst fines and biochar particles in a fluidizing gas and adhering a portion of the catalyst fines to the biochar particles while in the fluidizing gas.

19 Claims, 2 Drawing Sheets

(56) References Cited

U.S. PATENT DOCUMENTS

| | | | | |
|---|---|---|---|---|
| 8,772,559 | B2 | 7/2014 | Smaidris | |
| 8,986,581 | B2 | 3/2015 | Eddy et al. | |
| 9,109,177 | B2 | 8/2015 | Freel et al. | |
| 9,328,290 | B2 | 5/2016 | Cheiky et al. | |
| 2002/0144931 | A1* | 10/2002 | Sechrist | B04C 3/04 208/113 |
| 2010/0083566 | A1 | 4/2010 | Fredriksen et al. | |
| 2012/0277499 | A1* | 11/2012 | Boon | C10B 49/22 585/240 |
| 2013/0068997 | A1 | 3/2013 | Yanik et al. | |
| 2013/0145683 | A1 | 6/2013 | Freel et al. | |
| 2013/0299332 | A1 | 11/2013 | Smaidris | |
| 2014/0030250 | A1 | 1/2014 | Eddy et al. | |
| 2014/0034550 | A1* | 2/2014 | Baird | C10G 51/04 208/73 |
| 2014/0034552 | A1* | 2/2014 | Baird | C10G 51/04 208/113 |
| 2014/0082996 | A1 | 3/2014 | Cheiky et al. | |

OTHER PUBLICATIONS

Search Report dated Dec. 29, 2015 for corresponding PCT Appl. No. PCT/US2015/052164.

* cited by examiner

METHODS FOR REDUCING FLUE GAS EMISSIONS FROM FLUID CATALYTIC CRACKING UNIT REGENERATORS

CROSS-REFERENCE TO RELATED APPLICATIONS

This application is a Continuation of copending International Application No. PCT/US2015/052164 filed Sep. 25, 2015, which application claims priority from U.S. Provisional Application No. 62/056,693 filed Sep. 29, 2014, the contents of which cited applications are hereby incorporated by reference in their entirety.

TECHNICAL FIELD

The present disclosure generally relates to methods for processing hydrocarbons. More particularly, the present disclosure relates to methods for reducing flue gas particulate emissions from fluid catalytic cracking (FCC) unit regenerators by the addition of biochar to the FCC unit feedstock.

BACKGROUND

The fluid catalyst cracking or "FCC" process has been extensively relied upon for the conversion of starting materials, such as vacuum gas oils and other relatively heavy oils, into lighter and more valuable products. In an FCC reaction zone, the starting material, whether it be vacuum gas oil or another oil, is contacted with a finely particulated, solid catalytic material that behaves as a fluid when mixed with a gas or vapor. This catalytic material possesses the ability to catalyze the cracking reaction. During the cracking reaction, coke is deposited on the surface of the catalyst as a by-product of the cracking reaction. Coke includes hydrogen, carbon, and other material such as sulfur, and it interferes with the catalytic activity of FCC catalysts.

Facilities for the removal of coke from FCC catalyst, so-called regeneration facilities or "regenerators", are ordinarily provided within an FCC unit. Typically, coke-contaminated catalyst enters the regenerator and is contacted with an oxygen containing gas at conditions such that the coke is oxidized. A flue gas, which includes excess regeneration gas and the gaseous products of coke oxidation, as well as solid particulate matter that is removed from the catalyst during regeneration and commonly referred to as "catalyst fines," leaves the regenerator by a flue vent that is located at the top of the regenerator. The fluidized catalyst is continuously circulated from the reaction zone to the regeneration zone and then again to the reaction zone. Catalyst exiting the reaction zone is referred to as being "spent", that is partially deactivated by the deposition of coke upon the catalyst. Catalyst from which coke has been substantially removed is referred to as "regenerated" catalyst.

In recent years, some environmental control agencies have begun to place limits or "caps" on the amount of particulate matter that may be vented through the flue vent. In circumstances where it is found that the flue gas contains particulate matter at levels that exceed such caps, it is typically required to install one or more particulate removal systems, such as flue gas scrubbers, separators, electrostatic precipitators, and/or other filtering units, at the flue vent. The installation and operation of these particulate removal systems adds significant capital and operational expenses to the FCC process.

Accordingly, it is desirable to provide improved FCC processes. In addition, it is desirable to provide such processes that reduce the amount of particulate material contained within the FCC regenerator flue gas. Still further, it is desirable to provide such processes that do not require, or that reduce the need for, particulate removal systems installed at the flue vent. Furthermore, other desirable features and characteristics will become apparent from the subsequent detailed description and the appended claims, taken in conjunction with the accompanying drawings and this background.

BRIEF SUMMARY

Methods for reducing flue gas particulate emissions from fluid catalytic cracking unit regenerators are provided. In an exemplary embodiment, a method for reducing flue gas particulate emissions from an FCC unit regenerator includes the steps of combining biochar with a hydrocarbon feedstock to generate a biochar-containing feedstock and contacting the biochar-containing feedstock with an FCC catalyst.

In another exemplary embodiment, a method for reducing flue gas particulate emissions from an FCC unit regenerator includes the steps of fluidizing catalyst fines and biochar particles in a fluidizing gas and adhering a portion of the catalyst fines to the biochar particles while in the fluidizing gas.

In yet another exemplary embodiment, a method for reducing flue gas particulate emissions from an FCC unit regenerator includes the steps of mixing regenerated FCC catalyst particles, and catalyst fines with a hydrocarbon feedstock, contacting the hydrocarbon feedstock with the biochar to generate a cracked hydrocarbon product and spent FCC catalyst particles, and separating the spent FCC catalyst particles from the cracked hydrocarbon product, the biochar, and the catalyst fines.

BRIEF DESCRIPTION OF THE DRAWINGS

Various embodiments will hereinafter be described in conjunction with the following drawing figures, wherein like numerals denote like elements, and wherein.

DETAILED DESCRIPTION

The following detailed description is merely exemplary in nature and is not intended to limit the application and uses of the embodiment described. Furthermore, there is no intention to be bound by any theory presented in the preceding background or the following detailed description.

The various embodiments described herein relate to methods for reducing flue gas emissions from fluid catalytic cracking unit regenerators. In accordance with certain embodiments, the disclosed methods employ the addition of "biochar"-containing feedstock oil to the conventional vacuum gas or other oil used as a feedstock for the FCC reactor (or alternatively adding biochar directly to a conventional feedstock). As known in the art, the term "biochar"

denotes the charcoal-like particulate material that is formed as a byproduct of the pyrolysis or other rapid thermal processing of biomass. The biochar particulate matter is coated with alkali metal contaminants, which derive from the biomass used in rapid thermal processes. The biochar particulate matter typically has a length-to-diameter ratio of for example about 6 to about 10, such as about 8, and a density that is for example about 10% to about 30%, such as about 20% that of the FCC catalyst. Accordingly, the aforesaid physical properties of the biochar particles make them difficult to be contained by the reactor cyclones, thus causing most of the biochar particles to travel to the FCC reactor main column. The alkali metal properties of the biochar attract the catalyst fines while in the fluidized state in the FCC reactor main column, such that some of the catalyst fines become adhered to some of the biochar particles. The biochar particles then carry the catalyst fines out the FCC reactor main column with the hydrocarbon product stream, which then enters a product distillation column. The biochar and the attracted catalyst fines are removed from the product distillation column as part of a bottom product stream of the column, which is a liquid slurry. Accordingly, with a portion of the catalyst fines being removed from the FCC unit in the liquid slurry product from the product distillation column, the amount thereof found in the regenerator flue gas is reduced. This, in turn, reduces or eliminates (depending on the particular cap level) the need for particulate filtering equipment to be installed at the flue vent, which beneficially reduces the capital and operating costs of the FCC unit.

Figure 1:
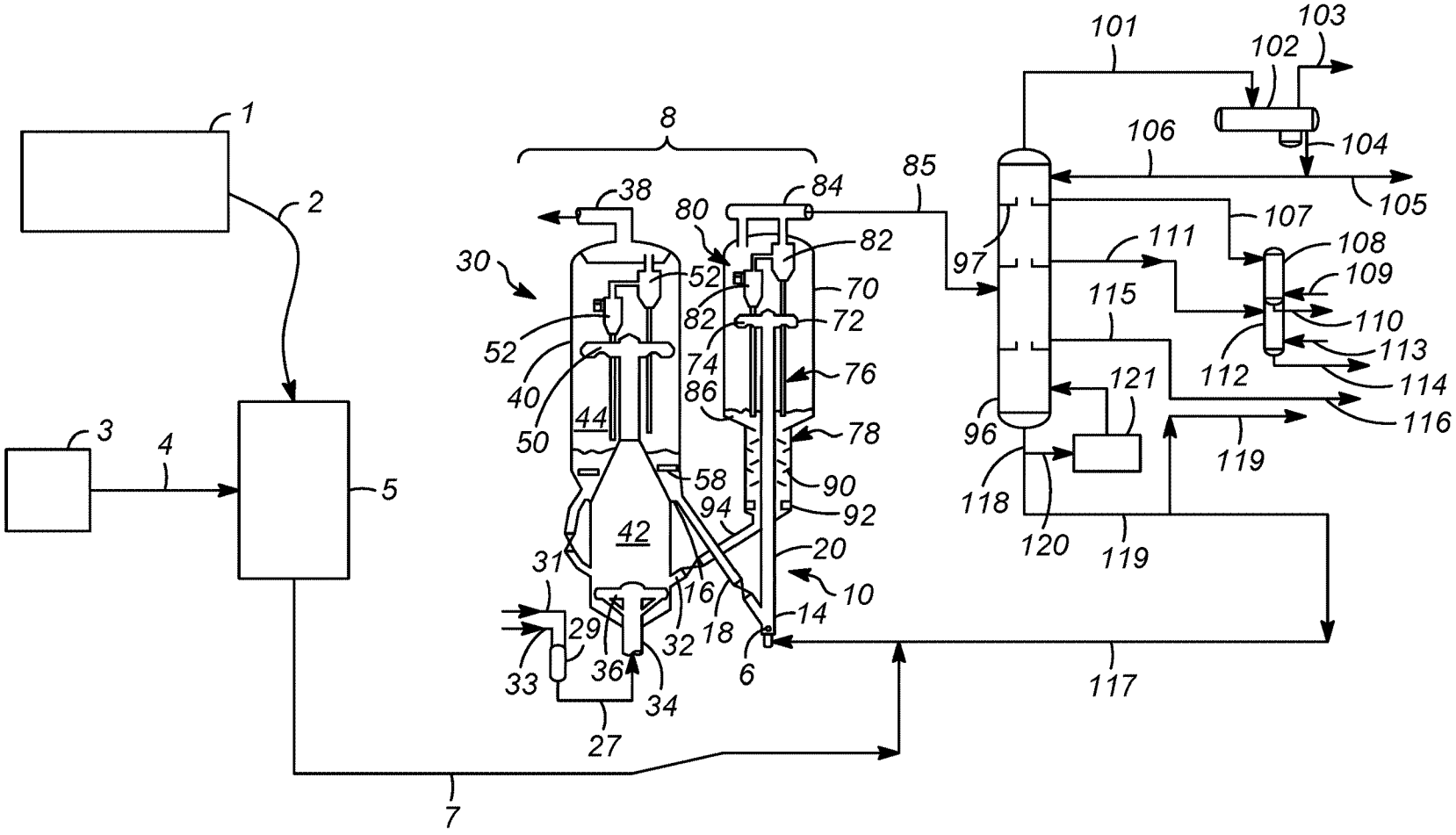
FIG. 1 is a schematic diagram of an FCC reactor and regenerator implementing a method for reducing flue gas particulate emissions in accordance with various embodiments of the present disclosure.
Figure 2:
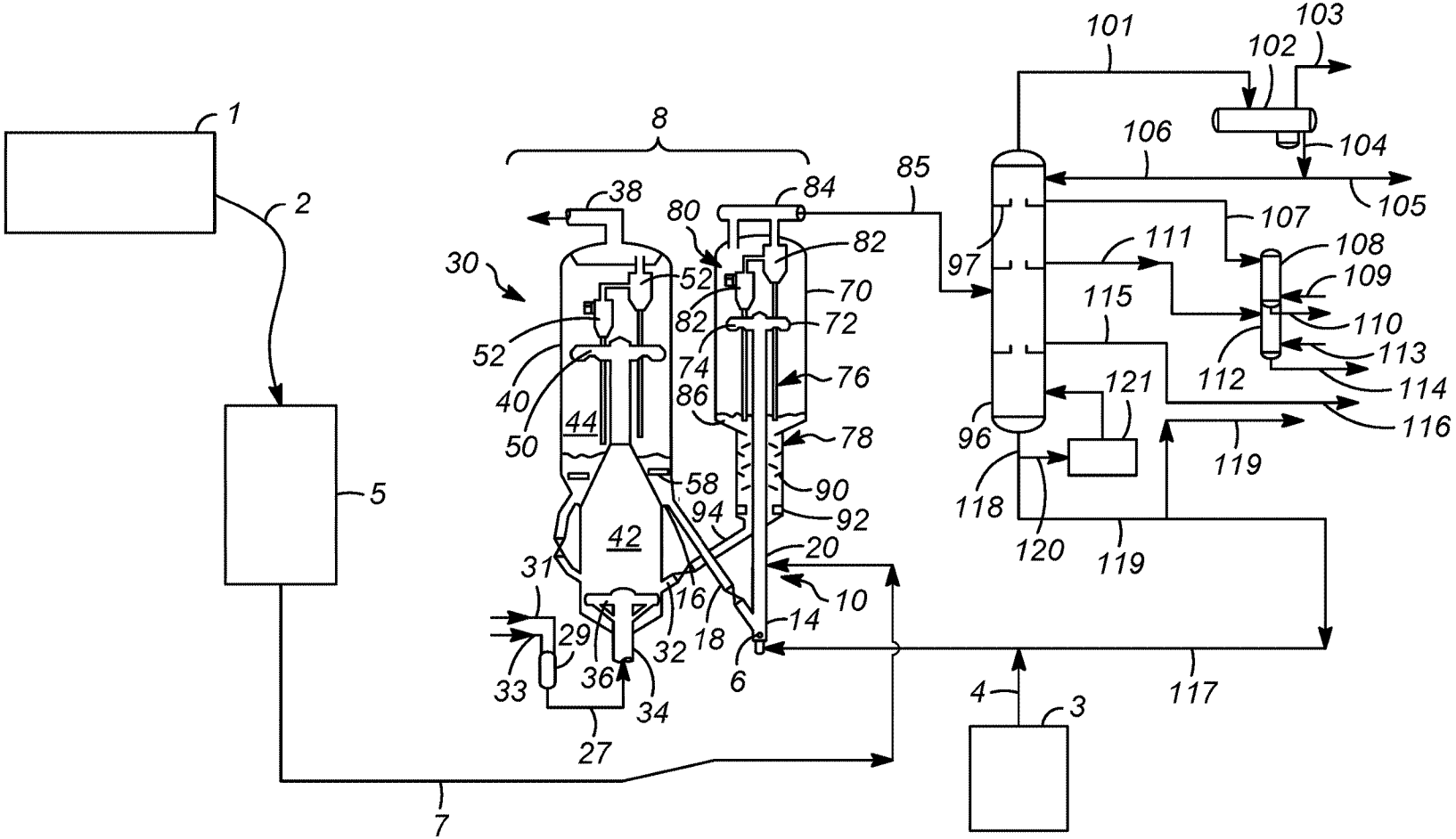
FIG. 2 is a schematic diagram of an FCC reactor and regenerator implementing a method for reducing flue gas particulate emissions in accordance with further embodiments of the present disclosure.

Various embodiments of the present disclosure will now be described in connection with FIGS. 1 and 2, which both are schematic diagrams of an FCC reactor and regenerator implementing a method for reducing flue gas particulate emissions. Embodiments described herein can be applied to any FCC unit that uses a catalyst regenerator. An exemplary FCC unit 8 is shown in FIGS. 1 and 2, the difference between FIGS. 1 and 2 being how the biochar is delivered to the FCC unit 8. While exemplary structures and processes are described below in relation to the FCC unit 8 of FIGS. 1 and 2, such structures and processes are provided merely to illustrate an exemplary embodiment, and should not be thought of as limiting. In the FCC unit 8 of FIGS. 1 and 2, a hydrocarbon feedstock may be sprayed by distributors 10 into a reactor vessel or riser 20, where it contacts an FCC catalyst. In general, the feedstock may be cracked in the riser 20 in the presence of the catalyst to form a cracked product stream.

A conventional FCC feedstock is suitable as a portion of the feed to the riser 20. The most common of such conventional feedstocks is a "vacuum gas oil" (VGO), which is typically a hydrocarbon material having a boiling range of from about 343° C. to about 552° C. prepared by vacuum fractionation of atmospheric residue. Pyrolysis oil may be used to carry the biochar directly to the riser 20. Hydrocarbon feedstocks may also be used. The conventional feedstock portion of the feed to the riser 20 may make-up any desirable amount, for example greater than about 90% of the feed, greater than about 75%, or even greater than about 50% of the feed to the riser 20. The other portion of the feed to the riser 20 includes the biochar-containing feedstock oil. The actual oil thereof may be the same or different than the conventional portion of the feed, however, the biochar-containing portion includes an amount of biochar therein. With respect to the total feed to the FCC unit 8, exemplary amounts of biochar are, for example, less than about 0.2% by weight, less than about 0.1% by weight, or about 0.001% by weight. Turning first to FIG. 1, the conventional feedstock may originate from conventional feedstock source 3, and be delivered to a feed surge drum 5 via line 4. The feed surge drum 5 is provided to regulate the flow of feedstock to the FCC unit 8. The biochar may originate from a biochar source 1, and be delivered to the feed surge drum via line 2. In this embodiment, the biochar is delivered directly into the conventional feedstock before such feedstock is delivered to the FCC unit 8. As known in the art, biochar is available as a stand-alone product, derived from various thermal processes using biorenewable feedstocks. Within the feed surge drum 5, the conventional feedstock and biochar portions are combined, resulting in the aforesaid hydrocarbon feedstock in line 7 that is fed to the FCC unit 8. From line 7, the hydrocarbon feedstock (containing some amount of biochar) may be vaporized and sprayed in the riser by the distributors 10.

In an alternative embodiment, as shown in FIG. 2, the biochar may be original from a pyrolysis oil source 1 that includes biochar, and be delivered to the surge drum 5 via line 2. The pyrolysis oil derives from various thermal processes using biorenewable feedstocks, without the biochar having been separated therefrom. Line 7 in FIG. 2, carrying the biochar-containing pyrolysis oil, may be delivered to the riser 20 above the hydrocarbon feed point. In FIG. 2, the conventional feedstock source 3, as in FIG. 1, includes the conventional hydrocarbon feedstock, which is delivered from the source 3 via line 4. Other manners of delivery of the biochar to the FCC unit 8 main column will be realized by those having ordinary skill in the art.

The biochar used in accordance with the methods disclosed herein may originate from any suitable source. Numerous processes are know in the art for the rapid thermal processing of biomass, and each of these processes produce some amount of biochar that may be used herein with the described methods. Exemplary biomass-producing rapid thermal processes are disclosed in, for example, United States Patent Applications: 2014/0082996, 2014/0030250, and 2013/0299332, among many others. The embodiments of the methods described herein should not be thought of as limited to any particular source of biochar.

The FCC catalyst used may be zeolitic molecular sieves having a large average pore size. Molecular sieves with a large pore size have pores with openings of greater than about 0.7 nm in effective diameter defined by greater than 10 and typically 12 membered rings. Suitable large pore molecular sieves include synthetic zeolites such as X-type and Y-type zeolites, mordenite, and faujasite. Exemplary molecule sieves are Y-type zeolites with low rare earth content. Low rare earth content denotes less than or equal to about 1.0 wt % rare earth oxide on the zeolitic portion of the catalyst. Catalyst additives may be added to the catalyst composition during operation. Medium pore sized molecular sieves such as MFI with openings of about 0.7 nm or less may be blended in with the large pore molecular sieves to increase production of lighter olefins, if desired. In some cases, only medium pore sized molecular sieves may be used if the feed to the riser is an FCC product cut such as a naphtha stream.

The riser 20 may operate with catalyst-to-oil ratio of from about 4 to about 12, such as from about 4 to about 10. Inert gas to the riser 20 may be from about 1 to about 15 wt % of hydrocarbon feed, such as from about 4 to about 12 wt %. Before contacting the catalyst, the biochar-containing hydrocarbon feed may have a temperature of from about 149° C. to about 427° C., such as from about 204° C. to about 288° C. The riser 20 may operate at a temperature of from about 427° C. to about 649° C., such as from about 482° C. to about 593° C. The pressure in the riser 20 may be from about 69 to about 241 kPa (gauge), such as from about 90 to about 110 kPa (gauge).

As a further alternative embodiment of the present disclosure, if it is not desirable for whatever reason to include the biochar with the hydrocarbon feedstock, the biochar may be delivered directly into the riser 20 via a suitable entry port that may be located at any portion along the riser, although preferably along a lower portion of the riser. As noted above in connection with FIG. 2, the biochar could be adding via a carrying fluid such as biomass-derived pyrolysis oil. Thus, the particular entry point of the biochar to the FCC unit 8 should not be viewed as a limiting aspect of the presently described embodiments.

As shown in FIG. 1, regenerated catalyst is delivered to the riser 20 from regenerator standpipe 18. In an embodiment, lift gas that may include inert gas such as steam may be distributed by lift gas distributor 6 to lift catalyst upwardly from a lower section 14 of the riser 20. Feed sprayed from a distributor 10 contacts lifted, fluidized catalyst and moves upwardly in the riser 20 as the biochar-containing hydrocarbon feed cracks to smaller hydrocarbon cracked products. The cracked products and spent catalyst enter the reactor vessel 70 and are then discharged from the top of the riser 20 through the riser outlet 72 and separated into a cracked product vapor stream and a collection of catalyst particles covered with substantial quantities of coke (i.e., the spent catalyst). A swirl arm arrangement 74, provided at the end of the riser 20, may further enhance initial catalyst and cracked hydrocarbon separation by imparting a tangential velocity to the exiting catalyst and cracked product vapor stream mixture. The swirl arm arrangement 74 is located in an upper portion of a separation chamber 76, and a stripping zone 78 is situated in the lower portion of the separation chamber 76. Catalyst separated by the swirl arm arrangement 74 drops down into the stripping zone 78.

The cracked product vapor stream including cracked hydrocarbons including naphtha, light olefins, and some catalyst may exit the separation chamber 76 via a gas conduit 80 in communication with cyclones 82. The cyclones 82 may remove remaining catalyst particles from the product vapor stream to reduce particle concentrations to very low levels. The product vapor stream may exit the top of the reactor vessel 70 through a product outlet 84 and product stream 85. Catalyst separated by the cyclones 82 returns to the reactor vessel 70 through diplegs into a dense bed 86 where catalyst will pass through chamber openings and enter the stripping zone 78. The stripping zone 78 removes adsorbed and entrained hydrocarbons from the catalyst by counter-current contact with inert gas such as steam over a series of baffles 90. Steam may enter the stripping zone 78 through a distributor 92. A spent catalyst conduit 94 transfers coked catalyst, regulated by a control valve, to a catalyst regenerator 30. Additionally, a spent catalyst recycle conduit (not shown) may transfer some spent catalyst back to the riser 20 below the feed distributor arrangement 10 without undergoing regeneration.

As shown in FIG. 1, the catalyst regenerator 30 receives the coked catalyst through an inlet 32 and typically combusts the coke from the surface of the catalyst particles by contact with an oxygen-containing gas (line 31) and a combustion fuel (line 33). The oxygen-containing combustion gas and fuel are combined in mixer 29, and then the combined stream travels via line 27 and enters the bottom of the regenerator 30 via an inlet 34 to a combustion gas distributor 36. Flue gas and entrained catalyst pass upwardly through the regenerator 30. Flue gas exits the regenerator through a flue gas outlet 38. The catalyst regenerator 30 includes a regenerator vessel 40 that includes a lower chamber 42 and an upper chamber 44. Air is delivered to chamber 42 via line 31.

A primary separator, such as a tee disengager 50, initially separates catalyst from flue gas. Regenerator cyclones 52, or other means, remove entrained catalyst particles from the rising flue gas before the flue gas exits the vessel through the flue gas outlet 38. The regenerator cyclones, however, typically are not capable of removing catalyst fines, and in prior art system such catalyst fines would have escaped the regenerator through the flue gas via outlet 38. However, in accordance with embodiments of the present disclosure, the biochar particles that were fed to the unit 8 entrained the catalyst fines out with the hydrocarbon vapors in cyclones 82. The alkali metal properties of the biochar attract the catalyst fines while in the fluidized state. Disengaged catalyst may exit from the regenerator vessel 40 through a regenerated catalyst outlet 16 to the regenerator standpipe 18. The catalyst may pass, regulated by a control valve, through the regenerator standpipe 18 to the lower section 14 of the riser 20. From there, the catalyst returns to use in cracking the feedstock, and the biochar particles carry the catalyst fines out the reactor with the hydrocarbon product stream in line 85.

Regenerated catalyst from the regenerator standpipe 18 will usually have a temperature from about 649° C. to about 760° C. If air is used as the oxygen-containing gas, the dry air rate to the regenerator may be from about 8 to about 15 kg/kg coke. The hydrogen in coke may be from about 4 to about 8 wt %, and the sulfur in coke may be from about 0.6 to about 3.0 wt %. In some embodiments, although not illustrated in FIG. 1 for simplicity, a catalyst cooler is provided to cool regenerated catalyst.

The product vapor stream exiting via product outlet 84 may be transferred to a suitable product distillation column 96 via line 85 for separation of the various product fractions. The vapor product in line 85 may pass through various heat exchange units (not illustrated) to cool the product such that at least some of the product is in a liquid state prior to entering the product distillation column 96. Line 85 will typically enter the column 96 at a mid-point thereof, as illustrated. Column 96 includes a plurality of trays 97 or other means to effectively separate the various product fractions of the cracked hydrocarbon product based on differences in boiling point.

Distillation column 96 may include a vapor overhead product stream 101 that contains various lower-boiling hydrocarbons, such as gasoline fraction hydrocarbons and lighter. The overhead product stream 101 may be passed to an overhead receiver unit 102 that operates to separate the gasoline fraction of the overhead product from the lighter hydrocarbons of the basis of phase separation, for example by partially condensing the overhead product stream. The lighter hydrocarbons exit the overhead receiver unit via stream 103, and may be flared-off or used as fuel. The gasoline fraction may be removed from the overhead receiver unit 102 via line 104, a first portion 105 of which may exit the system for further refinement, and a second portion 106 of which may be returned to the column 96 as reflux.

Distillation column 96 may also include an upper side-cut product stream 107 that includes naphtha boiling range hydrocarbons. The naphtha hydrocarbons may be delivered to an appropriate stripping unit 108 wherein they are contacted with steam provided via line 109 and stripped. The stripped naphtha exits stripping unit 108 via stream 110, whereafter it may be further refined.

Distillation column 96 may also include a mid side-cut product stream 111 that includes light cycle oil (LCO) boiling range hydrocarbons. The LCO hydrocarbons may be delivered to an appropriate stripping unit 112 wherein they are contacted with steam provided via line 113 and stripped. The stripped LCO exits stripping unit 112 via stream 114, whereafter it may be further refined.

Distillation column 96 may further include a lower side-cut product stream 115 that includes heavy cycle oil (HCO) boiling range hydrocarbons. The HCO hydrocarbons may exit the system via line 116 for further.

Still further, distillation column 96 may include a bottom product stream that contains various heavy distillates, tars, and the like that result from the FCC cracking process. The bottoms stream forms a slurry that is removed from the column 96 via line 118, a first portion of which in line 119 may be removed from the system as a product, and a second portion of which in line 120 may be fed to a suitable reboiler unit 121 and eventually returned to the distillation column in a vaporized form. A third portion, as line 117, may be recycled to join with line 7 as shown in FIG. 1, or line 4 as shown in FIG. 2. Alternatively, it may be sent directly to the riser without premixing with line 7 or line 4. As initially noted above, the biochar particles carry the catalyst fines out the reactor with the hydrocarbon product stream 85, which enters the product distillation column 96. The biochar and the attracted catalyst fines are removed from the product distillation column 96 as part of the bottom product stream 118,119 of the column, which as noted is a liquid slurry. Accordingly, with a portion of the catalyst fines being removed from the FCC unit 8 in the liquid slurry product from the product distillation column via line 119, the amount thereof found in the regenerator flue gas leaving via flue gas outlet 38 is reduced.

Accordingly, the described embodiments herein have provided methods for reducing flue gas particulate emissions from fluid catalytic cracking (FCC) unit regenerators by the addition of biochar to the FCC unit feedstock. The described methods reduce the amount of catalyst fine particulate material contained within the FCC regenerator flue gas and thereby reduce or eliminate the need for expensive particulate removal systems installed at the flue vent.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the application in any way. Rather, the foregoing detailed description will provide those skilled in the art with a convenient road map for implementing one or more embodiments, it being understood that various changes may be made in the function and arrangement of elements described in an exemplary embodiment without departing from the scope, as set forth in the appended claims.

The invention claimed is:

1. A method for reducing flue gas particulate emissions from a fluid catalytic cracking (FCC) unit regenerator comprising the steps of:

combining biochar with a hydrocarbon feedstock to generate a biochar-containing feedstock, wherein said biochar is derived from rapid thermal processing of biomass;

contacting the biochar-containing feedstock with an FCC catalyst; and regenerating said FCC catalyst to produce the flue gas.

2. The method of claim 1, further comprising the step of delivering the biochar-containing feedstock to the FCC unit, wherein combining the biochar with the hydrocarbon feedstock is performed prior to the step of delivering.

3. The method of claim 1, further comprising the step of delivering the hydrocarbon feedstock to the FCC unit, wherein combining the biochar with the hydrocarbon feedstock is performed subsequent to the step of delivering.

4. The method of claim 1, wherein combining the biochar with the hydrocarbon feedstock is performed to generate a biochar-containing feedstock having a concentration of biochar from about 0.001 to about 0.2 weight percent with respect to total biochar-containing feedstock.

5. The method of claim 1, further comprising the step of regenerating the FCC catalyst subsequent to the step of contacting, wherein the step of regenerating produces catalyst fines.

6. The method of claim 5, wherein the step of contacting the biochar-containing feedstock with the FCC catalyst is performed under catalytic cracking conditions to generate a cracked hydrocarbon product.

7. The method of claim 6, further comprising separating the FCC catalyst from the biochar and the cracked hydrocarbon product to form an FCC unit product stream comprising the biochar, and the cracked hydrocarbon product.

8. The method of claim 7, further comprising the step of delivering the FCC unit product stream to a distillation column.

9. The method of claim 8, further comprising the step of removing the biochar and the catalyst fines from the distillation column as part of a bottom product stream.

10. The method of claim 8, further comprising the step of separating the cracked hydrocarbon product into one or more of a gasoline product, a naphtha product, a light cycle oil product, and a heavy cycle oil product.

11. The method of claim 1, wherein the step of contacting with the FCC catalyst comprises contacting with one or more of a zeolite, mordenite, and faujasite catalyst.

12. The method of claim 1, wherein the step of combining the biochar with the hydrocarbon comprises combining a biomass-derived pyrolysis oil comprising biochar with a conventional hydrocarbon feedstock.

13. A method for reducing flue gas particulate emissions from a fluid catalytic cracking (FCC) unit regenerator comprising the steps of:

fluidizing FCC catalyst, catalyst fines, and biochar particles in a fluidizing gas;

adhering a portion of the catalyst fines to the biochar particles while in the fluidizing gas; and regenerating said FCC catalyst to produce the flue gas.

14. The method of claim 13, further comprising the step of fluidizing regenerated FCC catalyst particles along with the catalyst fines and the biochar particles in the fluidizing gas.

15. The method of claim 14, further comprising the step of collecting spent catalyst particles in a cyclone for subsequent regeneration of the spent catalyst particles.

16. The method of claim 15, wherein the step of collecting spent catalyst particles further comprises substantially preventing the catalyst fines and biochar particles from being collected in the cyclone.

17. The method of claim 16, further comprising delivering the collected, spent catalyst particles to a catalyst regenerator.

18. The method of claim 13, wherein the step of fluidizing catalyst fines with biochar particles comprises fluidizing catalyst fines with biochar particles comprising alkali metal contaminants.

19. A method for reducing flue gas particulate emissions from a fluid catalytic cracking (FCC) unit regenerator comprising the steps of:

mixing regenerated FCC catalyst particles, and catalyst fines with a hydrocarbon feedstock;

contacting the hydrocarbon feedstock with biochar to generate a cracked hydrocarbon product and spent FCC catalyst particles;

separating the spent FCC catalyst particles from the cracked hydrocarbon product, the biochar, and the catalyst fines; and regenerating said spent FCC catalyst to produce the flue gas.

* * * * *